United States Patent [19]

Knapp

[11] 3,946,820

[45] Mar. 30, 1976

[54] NOVEL CUTTER ELEMENTS FOR DRILL BITS

[75] Inventor: Seth Raymond Knapp, Ardmore, Okla.

[73] Assignee: Laurilda Ferne Knapp, Ardmore, Okla.

[22] Filed: Oct. 25, 1974

[21] Appl. No.: 517,875

[52] U.S. Cl. ..... 175/341; 175/353; 175/374; 175/376

[51] Int. Cl.[2] ..... E21B 9/10; E21C 13/00

[58] Field of Search ..... 175/327, 331, 341, 350, 175/353, 355, 374, 377, 376, 378

[56] References Cited

UNITED STATES PATENTS

| | | | |
|---|---|---|---|
| 2,527,838 | 10/1950 | Morland et al. | 175/376 |
| 2,887,302 | 5/1959 | Garner | 175/376 X |
| 3,104,726 | 9/1963 | Davis | 175/331 |
| 3,401,759 | 9/1968 | White | 175/341 |
| 3,547,209 | 12/1970 | McLamore | 175/378 X |
| 3,800,891 | 4/1974 | White et al. | 175/374 |

FOREIGN PATENTS OR APPLICATIONS

| | | | |
|---|---|---|---|
| 1,113,037 | 5/1968 | Canada | 175/374 |

*Primary Examiner*—David H. Brown

*Attorney, Agent, or Firm*—Joseph H. Schley; Thomas L. Cantrell

[57] ABSTRACT

Improved cutter elements for drill bits of the type having two to four conical-shaped cutters mounted in a supporting body for rotation about their respective axes with their apices inclined downwardly-inwardly toward the axis of rotation of the body; the cutter elements are spaced apart from one another both axially and circumferentially of the substantially conical exterior of each conical-shaped cutter and, usually, disposed in spaced circumferential rows, each cutter element including a pair of interacting chisel or wedge-shaped teeth intersecting each other—preferably at their medial portions in perpendicular relationship—coextensive from crest to root and having their respective crests extending approximately radially of the axis of rotation of said cutter and generally circumferentially of said cutter axis; the circumferentially—oriented teeth have coextensive cutting edges at their ends and are adapted to cut through ridges created in the formation by the radially-oriented teeth and laterally displace cuttings of the latter as well as contact said formation ahead or prior thereto so as to permit greater penetration of said radially-oriented teeth.

Both teeth of each cutter element may be of relatively narrow transverse dimensions or thickness as well as minimum taper, such as 40° or less, and the circumferential spacing between adjacent cutter elements may be relatively wide without unduly weakening said teeth, whereby a drill bit having such cutter elements may be utilized in varying formations, from relatively soft to relatively hard, so as to minimize the necessity of replacing the bit before exhaustion of its usefulness.

18 Claims, 9 Drawing Figures

NOVEL CUTTER ELEMENTS FOR DRILL BITS

BACKGROUND OF THE INVENTION

Conventional earth boring drill bits of the roller cone or rotary conical cutter type have discrete chisel or wedge-shaped teeth with their crests extending longitudinally of their respective cone and in planes approximately radially of the respective axis of rotation thereof or transversely of its respective direction of rotation. Usually, these teeth have a taper in the range of 42° to 46° in order to prevent excessive tooth breakage, and this tooth angle is maintained regardless of the density (soft, medium, hard) of the formation to be drilled as well as of the length and spacing of said teeth. In addition to the circumferential spacing thereof, the teeth are disposed in spaced circumferential or concentric rows with the rows of each cone being offset relative to the rows of adjacent cones. In most instances, the length of and the distance between adjacent circumferential teeth is determined by the density of the earth formation to be drilled, which is generally classified as soft, medium or hard and which varies according to the strata of the earth, with such teeth length and distance therebetween decreasing with increasing density or hardness and with the shortened teeth being as close together as possible. It is noted that formations of varying density or hardness are disposed frequently in adjacent strata of relative thinness.

The aforesaid approximate 42° to 46° taper results in thickened crests or cutting edges, which thickness increases in proportion to the extent of wear of the teeth and is amplified when said teeth are relatively long, thereby requiring the application of additional weight in order to penetrate the formation. Obviously, the applied weight must not exceed the bearing capacity of the roller cones or the total weight of the collars of a string of drill pipe. Teeth of this type are prone to breakage when a denser or harder formation is encountered, and attempts to reduce this tendency have included increasing the taper and the thickness or lesser transverse dimension of the teeth (tooth width transverse to taper) and/or shortening the length of said teeth; however, this manner of strengthening the teeth, again results in thickened crests or bread cutting surfaces upon wear of the teeth so as to resist penetration of the formation and necessitate the application of additional weight on the drill bit in order to obtain a satisfactory penetration rate.

Drill bit cones having rows of closely spaced teeth for use in medium to medium hard formations usually create a pattern in the formation known as "gearing", the teeth tending to contact the formation in depressions formed by said teeth during a previous revolution of the cone. Due to this "gearing" action, ridges are created between adjacent depressions which strengthen the formation and resist fracture thereof by the teeth.

In a drill bit cone having tooth crests extending longitudinally thereof and in planes extending approximately radially of the axis of rotation thereof, the depth of penetration of each tooth into the formation is restricted by the engagement of its adjacent teeth in each row of teeth with said formation whereby the amount of penetration is dependent upon the distance between said teeth. As shown in FIGS. 5–8, each center tooth of any group of three adjacent teeth in any row penetrates the formation until the following or trailing tooth contacts the formation. Since the lead or preceding tooth remains in engagement at this point, penetration ceases because all three of the teeth attempt to enter the formation at different angles whereby additional penetration is impossible. This action is repeated by each group of three teeth and determines the maximum penetration by a drill bit during each revolution. As each cone rotates on its axis, the following tooth of each of the aforesaid groups presents a flat surface to the formation (FIG. 5), and this tooth cannot penetrate until the cone revolves sufficiently to position said tooth directly under said cone so that its cutting edge or crest fractures and forces the formation to either side of said tooth.

If the teeth are widely spaced circumferentially to permit deeper penetration by each tooth in turn, the following or trailing tooth may break as the load or weight of the drill string is applied to its flat side. If it does not break, this tooth must lift the load until it is directly beneath the cone so as to penetrate the formation. Another disadvantage is that in soft or gummy formations, such as gumbo or shale, cuttings pack in the recesses between the flat surfaces of adjoining teeth in each row and the shell of the cone. This mass of cuttings is dehydrated by engagement with the formation and the hydrostatic pressure of the fluid column in the well hole, this condition being commonly known as and referred to as bit balling (a balled up drill bit). It is noted that the mass of cuttings between adjacent teeth becomes firm and dense and may extend to the crest of said teeth, whereby it supports the weight applied to a drill bit and prevents penetration into the formation by said teeth.

Another problem frequently encountered is known as "tracking" which is caused by a circumferential row of teeth sliding into a depression caused by an offset row of teeth on one of the other cones. This action leaves circumferential ridges of uncut formation which create wear on the ends of the radial teeth crests and stop penetration since the height of the ridges exceeds the remaining tooth length or height and the cone shell or exterior rests on said formation ridges. Also, the "tracking" action causes the guage surfaces of a drill bit to abrade the wall of the well hole and drill a bore which is of greater diameter than said bit. Under these conditions penetration of the bit ceases and it must be replaced by another type.

In order to increase the rate of penetration in formations, such as shale, the roller cones of a conventional drill bit have the inner ends of their axes of rotation offset relative to the axis of rotation of said bit whereby said cones bear outwardly so as to provide radial or transverse movement for more efficiently fracturing the formation, particularly the annular ridges formed therein during previous revolutions. Unfortunately, the rotation of the drill bit causes the radial teeth of each cone to slide inwardly toward the rotational axis of said bit; and the resultant abrasion of said teeth causes more rapid wear thereof and increases the radial load or thrust exerted on the bearings of the cones so as to appreciably shorten the life of said bearings.

SUMMARY OF THE INVENTION

Herein for convenience, the radially-oriented teeth may be referred to as "radial" or "transverse" teeth, the circumferentially-oriented teeth as "circumferential" or "parallel" teeth, and the bottom of a well as the "hole bottom" or "formation".

The essence of the invention resides in providing novel cutter elements for the cone-shaped rotary cutters of drill bits, wherein each cutter element is quadrangular at its base, of X-shape or cruciform configuration in plan and has intersecting radially-oriented and circumferentially-oriented chisel or wedge-shaped teeth which intersect to reinforce each other so as to have sufficient strength to efficiently penetrate and disintegrate medium or relatively hard or dense formations without premature wear and breakage, the interacting reinforcement of the teeth permitting minimum taper, such as 40° or less in comparision to the standard 42° to 46° taper, of said teeth so that a faster penetration rate may be attained without the use of excessive weight, and said minimum taper permitting said teeth to be of sufficient length and thinness to disintegrate relatively soft formations efficaciously, whereby a drill bit need not be withdrawn from a well and replaced prior to exhaustion of its usefulness when harder or softer formations are encountered. Preferably, the teeth of each cutter element intersect at the medical portions thereof in perpendicular or right anglar relationship.

The crest of one of the intersecting teeth of each cutter element is disposed in a plane transverse to the direction of rotation of its cutter and approximately radially of the axis of rotation of said cutter, while the crest of the other intersecting tooth is linear and extends approximately circumferentially or concentrically of the approximately conical exterior of said cutter as well as transversely of said radially-oriented tooth. The teeth of each cutter element are coextensive in length from crest to base or root and, preferably, the crest of the circumferentially-oriented tooth is convex longitudinally so as to taper toward its ends whereby said element may be of maximum length without danger of striking adjacent rotary cutters. Although it is desirable for each circumferentially-oriented tooth to be perpendicular to its intersecting radially-oriented tooth and for the teeth to bisect the medial portions of each other, it is readily apparent that the intersection of said teeth may be offset relative to their respective centers and for said teeth to be disposed obliquely to each other. Also, the teeth crests of each cutter element may, but need not, be of equal length.

In addition to the cutter elements of each cone-shaped cutter being spaced from one another both axially and circumferentially thereof, it is noted that the circumferentially-oriented teeth are spaced from one another so as to ensure circulation of drilling fluid and cleansing of the cutter elements. As well as contacting the formation prior to the radially-oriented teeth, the circumferentially-oriented teeth of the cutter elements cut the formation, particularly any ridges formed by said radially-oriented teeth, and laterally displace the formation cuttings of the latter so as to permit greater penetration of said radially-oriented teeth. The leading and trailing ends of the circumferential teeth have coextensive cutting edges which face the tapered flat sides or surfaces of the radial teeth of the adjacent cutter elements in each row so as to project into the recesses or spaces between said elements and thereby minimize bit balling.

Although illustrated as being convex and terminating flush with the crests of the radially-oriented teeth, the crest of the circumferentially-oriented teeth need not be convex and/or need not so terminate but may extend slghtly beyond the aforesaid teeth crests so as to penetrate the formation much sooner than said radially-oriented teeth. Attention is directed to the utility of the cutter elements provided by the interacting reinforcement by and between the intersecting teeth of each element, whereby said teeth may be of relatively narrow thickness or transverse dimension, conventional length and minimum taper, preferably 40° or less, without sacrificing strength or versatility. It is noted that the taper of the radial and circumferential teeth need not be identical and that it is more important for the radial teeth to be of minimum taper than the circumferential teeth since there is greater resistance to penetration by said radial teeth.

An important feature of the novel X-shaped or cruciform outer extremities of the cutter elements of this invention is that each of the cutting edges as well as the crest of each circumferentially-oriented tooth is a linear or straight edge whereby the front or leading edge of said tooth and the ends of said crest are a greater distance than the medial portion thereof from the rotational axis of the rotary cutter. As a result, the path of travel of the circumferential teeth is noncircular or polygonal in that it consists of a multiplicity of minute angles, whereby the front or leading end of the crest of each circumferential or parallel tooth as well as its adjacent cutting edge engage the formation prior to the intermediate portion of said tooth crest. Whether or not the rear or trailing end of each tooth crest follows the path of its front or leading end is dependent upon the angular relationship of the tooth crest to the axis of rotation of the rotary cutter and, consequently, the distance of said trailing end from said axis. Usually, however, the paths of travel are the same or thereabout. In any event, the entire tooth and its crest undergo a continuous slight twisting motion relative to the aforesaid rotational axis. In addition to cutting and laterally displacing any ridges in the formation formed by the radially-oriented teeth, the leading edges and crest ends of the circumferential teeth continually chip said formation due to the twisting action thereof. It is noted that the centerline of each cutter element is parallel to the axis of rotation of the drill bit when said element is at its lowest point in the path of rotation of its respective rotary cutter.

DESCRIPTION OF THE PREFERRED EMBODIMENT

Figure 1:
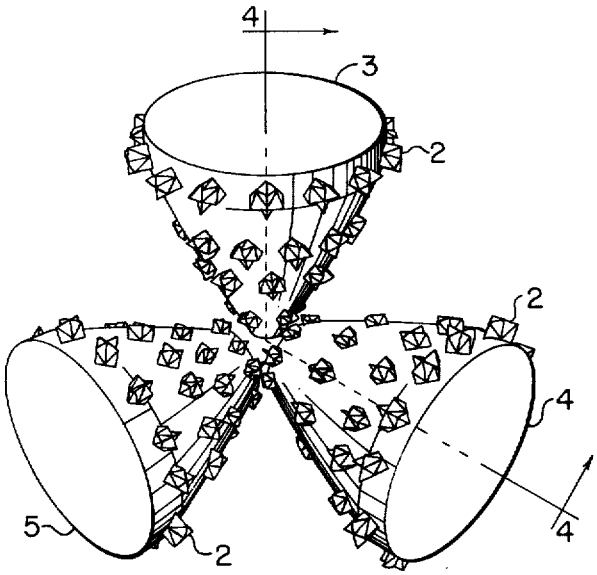
FIG. 1 is a plan view of an earth boring drill bit having the cruciform-rectangular cutter elements of its approximately conical-shaped rotary cutters constructed in accordance with the invention.
Figure 4:
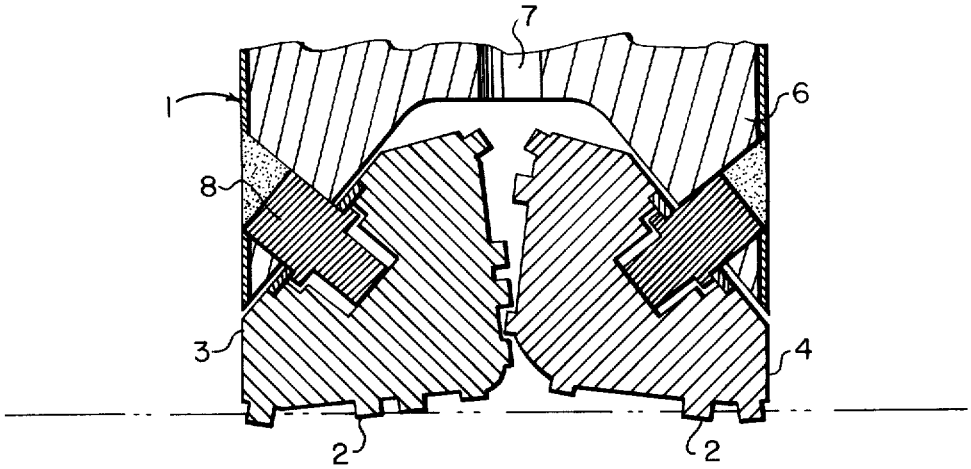
FIG. 4 is a reduced transverse vertical sectional view taken on the line 4—4 of FIG. 1 and showing the relationship of two of said novel rotary cutters and their diagonal teeth.
Figure 5:
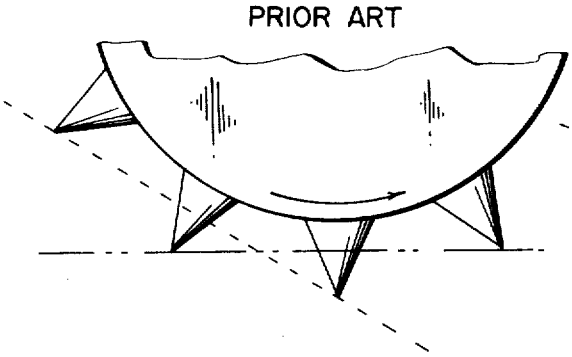
FIG. 5 is an enlarged elevational view of a portion of one of a prior art rotary cutter having conventional chisel-or-wedge-shape teeth schematically illustrating the penetration of an earth formation by the lowermost teeth of said cutter and both of its immediately adjacent teeth.

In the drawings, the numeral 1 designates the body of an earth boring drill bit having cutter elements 2, embodying the principles of the invention, on the substantially conical exterior of each of its conical-shaped rotary cutters or roller cones 3, 4, 5. As shown in FIG. 4, the bit body 1 has a plurality, such as two to four, or a trio of depending shanks 6 for rotatably supporting the rotary cutters 3, 4, 5 and one or more ports 7 therein for directing drilling fluid from a drill stem (not shown) between said cutters in the conventional manner. Each shank 6 has a spindle or trunion 8 extending inwardly-downwardly therefrom and one of the cutters is suitably mounted on each spindle for rotation about the axis thereof with the base or larger end portion of said cutter positioned outermost relative to the longitudinal axis of the drill bit body. Each of the rotary cutters 3, 4, 5 may be of the usual configuration, being shown (FIGS. 1 and 4) as having a relatively slight longitudinal curvature between its base and apex so as to present a modified convex exterior.

The cutter elements 2 of each rotary cone or cutter are spaced from one another both longitudinally and circumferentially of the substantially conical exterior of said cone or cutter as well as being disposed in spaced circumferential or concentric rows. Generally, the circumferential spacing of the cutter elements 2 of each row and/or the length of the cutter elements are varied in accordance with the density or hardness of the formation to be encountered, the spacing and/or length decreasing with the increase of density. As illustrated, it is customary for the rows of cutter elements of each rotary cutter to be offset or staggered with respect to the cutter element rows of each of the other cutters so as to engage different annular portions of the hole bottom or formation and substantially the entire area of the latter upon each revolution of the drill bit. Although shown as being integral with the cutters 3, 4, 5, it is readily apparent that the cutter elements 2 may be in the form of inserts for mounting in the approximately conical exteriors of said cutters whereby said elements may be of harder metal than said cutters.

Each cutter element may be substantially square or equilateral- rectangular in plan or cross-section (FIGS. 2 and 3) so as to have four equal or right angular margins or corners 11, 12, 13, 14 longitudinally coextensive therewith. Preferably, the opposed right angular margins or corners 11, 13 of each cutter element are aligned in a plane extending approximately radially of or perpendicular to the axis and direction of rotation of the rotary cutter carrying said cutter element, while the margins or corners 12, 14 of each element are aligned in a plane extending approximately circumferentially of said cutter and parallel to its rotational axis and direction. A chisel or wedge-shaped radial or transverse tooth 15 extends between the margins or corners 11, 13 diagonally of each element 2 and intersects a similar circumferential or parallel tooth 16 extending between the margins or corners 12, 14 diagonally of said element, the intersection being at the common center or medial portion of the teeth as shown at 10.

The radial tooth 15 and circumferential tooth 16 each have a pair of flat coacting flanks or surfaces 17, 18, respectively, disposed in acute angular relation to the flanks of the other tooth and tapering at 40° or less from a base point 21, 22, 23, 24 (common to the adjacent ends of both teeth and positioned between the margins or corners 11-12, 12-13, 13-14, 14-11) to respective radial and parallel intersecting crests 19, 20 at the apexes or points of said teeth. The radial or transverse crest 19 and the circumferential or parallel crest 20 are coextensive with their respective teeth 15, 16 and may be sharpened as shown by opposed bevel or chamfer faces 25, 26, respectively, having greater angular relationship than the flanks 17, 18 of said teeth. It is readily apparent that the radial tooth 15 and its crest 19 of each cutter element 2 extend substantially longitudinally of the exterior of each rotary cutter 3, 4, 5 as well as transversely of the direction of rotation and that the parallel tooth 16 and its crest 20 of said element extend circumferentially of said cutter exterior as well as generally parallel to said direction of rotation. Since the corners 11–14 are right angular and are coextensive with the teeth, cutting edges are provided by these corners for coacting with the crests.

It is noted that the teeth of each cutter element interact to reinforce each other, whereby said teeth are of sufficient strength to penetrate and disintegrate relatively hard or dense formations without premature excessive wear and breakage and of sufficient length and narrow thickness to efficiently disintegrate relatively soft formations. Also, it is pointed out that the interacting reinforcement by and between the teeth 15 and 16 of each cutter element permits said teeth to be of minimum taper, such as 40° or less, whereby the rate of penetration of said teeth may be increased without exceeding the load capacity of the collars of a drill string. Although it is not known how small the minimum taper of the teeth may be, said taper can be appreciably less than the conventional 42° to 46° since said teeth reinforce each other. At the present time, it is contemplated that this taper will be in the range of from 20° to 40° and that said taper may vary with the density of the formation. Since the penetration resistance of the radial teeth is greater than that of the circumferential teeth, the minimum taper is of primary importance with respect to said radial teeth.

Figure 6:
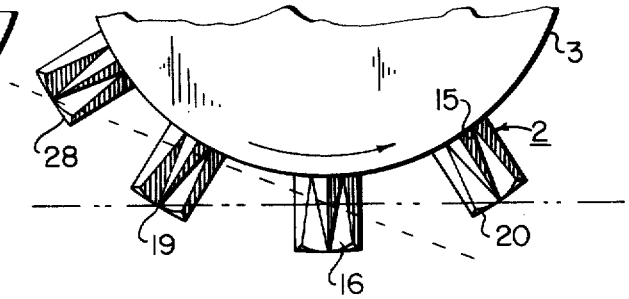
FIG. 6 is a view, similar to FIG. 5, showing the penetration of the formation by the lowermost cutter element of this invention and both of its immediately adjacent cutter elements.
Figure 7:
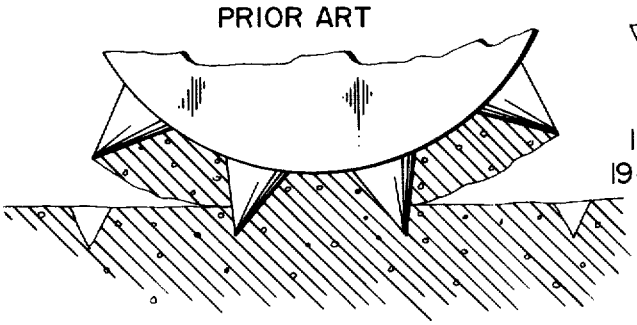
FIG. 7 is an enlarged elevational view of a portion of a prior art rotary cutter having conventional chisel or wedge-shaped teeth and showing the build-up of formation cuttings between said teeth.
Figure 8:
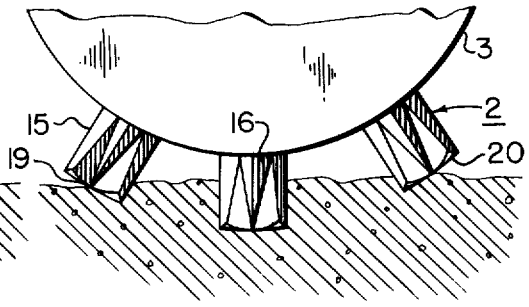
FIG. 8 is a view, similar to FIG. 7, illustrating the absence of build-up between said cruciform cutter elements of this invention and the greater penetration thereof.

Due to the aforesaid structure, it is unnecessary to withdraw and replace a drill bit (having the cutter elements 2 of this invention) prior to exhaustion of its usefulness when harder or softer formations are encountered. As shown in FIG. 6, it is readily apparent that the leading cutting edge 11 of the circumferential or parallel tooth 16 of each cutter element contacts the bottom hole or formation ahead of the radial or transverse tooth 15 of said element and that said parallel tooth is adapted to cut the ridges in said formation formed by said radial tooth as well as laterally displace or sweep the cuttings of the latter tooth. Due to the coacting reinforcement of the teeth of each cutter element 2, the circumferential spacing between adjacent elements is sufficient to ensure circulation of drilling fluid and thorough cleansing of said elements so as to minimize buildup of formation cuttings therebetween as shown in FIG. 8; the buildup of cuttings between conventional radial wedge-shaped teeth of prior art rotary cones or cutters being shown in FIG. 7.

It is manifest that the teeth of each cutter element may be disposed obliquely to each other as well as intersect at points other than their centers, although the aforesaid perpendicular or right angular center intersection of said teeth is preferred. In any event, each element 2 is X-shaped or cruciform in shape at its outer extremity due to the intersection of its teeth 15, 16 and the crest of each tooth is linear so as to present a straight edge to the formation. It is contemplated that one or more rows of the cutter elements may be of entirely different types of modified within the scope of this invention since many commercial drill bits have more than one type of cutter elements or teeth. As pointed out hereinbefore, both teeth of each cutter element may be of relatively narrow transverse dimensions or thickness, conventional length and minimum taper without sacrificing strength or versatility in view of the interacting reinforcement or bracing of the intersecting teeth.

Attention is directed to the fact that the intersecting teeth of each element 2 need not be identical, the crest 20 of the circumferential or parallel tooth 16 being shown at 28 as being convex and tapering from the common center point 10 to the ends of said tooth whereby said cutter element may be of maximum length without danger of striking adjacent rotary cutters. This tooth crest 20 or its center point may project beyond the crest 19 of the radial or transverse tooth 15 whereby the parallel tooth penetrates the formation much sooner than said radial tooth. Also, the crest 20 may be shorter or longer than the crest 19 or of equal length.

Figure 9:
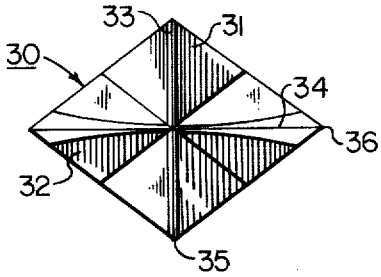
FIG. 9 is a view, similar to FIG. 3, of a modified cutter element in the shape of a rhombus.
Figure 2:
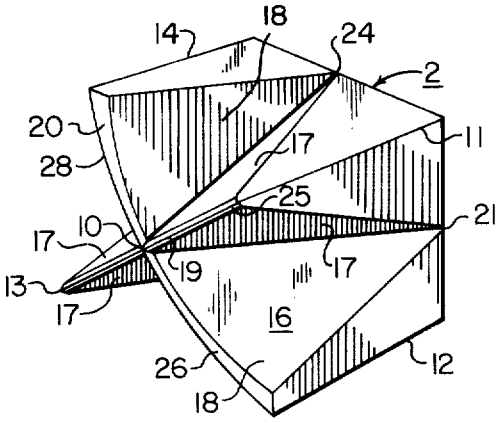
FIG. 2 is a greatly enlarged perspective view of one of said novel cutter elements, illustrating its intersectng diagonal teeth.
Figure 3:
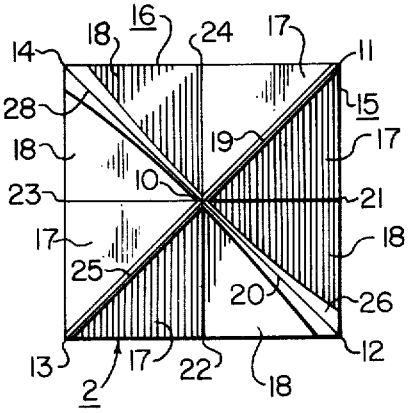
FIG. 3 is an enlarged plan view of one of novel said cutter elements, illustrating its equilateral rectangular base and its cruciform outer extremity.

As shown by the numeral 30 in FIG. 9, the cutter elements may be rhombus-shaped in plan rather than equilateral-rectangular as illustrated in FIGS. 2 and 3. As a result, each element 30 has a radially-oriented tooth 31 and crest 33 of less width than its circumferentially-oriented tooth 32 and its crest 34 whereby the cutting edges 36 of the tooth 32 are more acute or sharper than the cutting edge 35 of the tooth 31. In all other respects, the cutting elements are identical; it being noted that the element 30 may have a rear or trailing half of less taper than its leading half so as to be trapezoidal in plan. For greater efficiency, namely, faster disintegration of the formation and consequent more rapid penetration it is essential that the parallel tooth engage said formation prior to the radial tooth of each cutter element. Obviously, there is less resistance to penetration of the formation by the parallel teeth 16 due to their circumferential or concentric orientation relative to the axis of rotation of the respective axis of rotation of the cutter 3, 4, 5 of their respective element 2. Also, the disposition of the crests 20 of the parallel teeth in the direction of rotation of the drill bit contributes materially to the minimization of penetration resistance. In addition, it is noted that the orientation of the intersecting teeth of each cutter element may vary from exactly radial and/or parallel directions relative to the axes of rotation of its rotary cutter and the drill bit.

As stated hereinbefore, the angular relationship of the crest of the circumferential tooth of each cutter element determines the path of rotational travel of said crest. In any event, the front or leading end of the aforesaid tooth crest always is a greater distance than the major portion thereof from the rotational axis of its rotary cutter, while the rear or trailing end of said tooth crest may be the same or less distance from said axis. Therefore, the aforesaid tooth and its crest undergo a continuous twisting motion so as to displace fractured formation cuttings laterally. In addition to this sweeping action, the twisting action assists chipping of the formation and fracturing of ridges formed therein by the radial teeth.

It is further noted that the twisting action obviates the necessity of offsetting the axis of rotation of the cutters 3, 4, 5 with respect to the axis of rotation of the drill bit in order to provide a sliding, scraping action which assists in removing shale cuttings from the holebottom with conventional bit types for soft or medium hard formations. Instead, the inner ends of the aforesaid rotational axes of the rotary cutters have a common center at the rotational axis of the drill bit and there is no tendency for said cutters to drill an overgauge bore. Due to the aforesaid common center, sliding movement of the cutters is prevented whereby the useful life of the teeth and bearings of said cutters is extended. As set forth hereinbefore, the longitudinal axis of each cutter element is parallel to the axis of rotation of the drill bit when said element is at its lowest point in the path of rotation of its respective rotary cutter.

The foregoing description of the invention is explanatory thereof and various changes in the size, shape and materials, as well as in the details of the illustrated construction may be made, within the scope of the appended claims, without departing from the spirit of the invention.

I claim:

1. In an earth boring drill bit having at least one bearing means projecting downwardly-inwardly from the peripheral portion of its hollow body and a conical-shaped rotary cutter journaled on the bearing means with its large end outermost from the axis of the drill bit, the improvement which comprises a plurality of discrete cutter elements on the substantially conical exterior of the conical-shaped rotary cutter and spaced apart from one another both axially and circumferentially thereof, each of at least some of the cutter elements having a quandrangular base and including a pair of chisel-shaped teeth having crests at the outer extremity of and oriented diagonally of each of said cutter elements and intersecting at their medial portions, one of the chisel-shaped diagonally-oriented teeth of each of said quadrangular cutter elements having its crest extending generally radially of the axis of rotation of said conical-shaped rotary cutter, the other chisel-shaped diagonally-oriented tooth of each of said quadrangular cutter elements having its crest extending generally circumferentially of said cutter exterior, said teeth being coextensive from crest to root of each other and from the outer extremity to the base of each of said quadrangular cutter elements, whereby said teeth reinforce each other so as to permit minimum taper thereof and consequent faster penetration without the use of excessive weight and whereby circumferential spacing between said cutter elements may be relatively wide without unduly weakening said teeth, each of the circumferentially-oriented teeth having a linear longitudinal coextensive cutting edge at least at its leading end extending from its crest to its root at the base of its cutter element due to the orientation of said teeth diagonally of their respective cutter elements, the leading end of each of said circumferentially-oriented teeth having a coextensive face on each side of its longitudinal cutting edge with each face disposed in angular relation to the other and decreasing in width from said base to said outer extremity of its cutter element so as to reduce the thickness of the leading end crest portion of said tooth and thereby increase its penetration capability.

2. The improvement defined in claim 1 wherein at least some of the quadrangular cutter elements are equilateral in plan.

3. The improvement defined in claim 1 wherein at least some of the quadrangular cutter elements are parallelogrammatical in plan.

4. The improvement defined in claim 1 wherein at least some of the quadrangular cutter elements are rectangular in plan.

5. The improvement defined in claim 1 wherein at least some of the quadrangular cutter elements are diamond-shaped in plan.

6. The improvement defined in claim 1 wherein the angular relation between the faces at the leading ends of at least some of the circumferentially-oriented teeth is not more than 90°.

7. The improvement defined in claim 1 wherein the leading faces of at least some of the circumferentially-oriented teeth are equilateral.

8. The improvement defined in claim 1 wherein each of at least some of the circumferentially-oriented teeth has a pair of opposed lateral flanks tapering from the base to the outer extremity of its cutter element and terminating at the crest of said tooth in a coextensive linear cutting edge.

the leading margins of the opposed flanks forming the trailing margins of the leading faces of said circumferential teeth.

9. The improvement defined in claim 1 wherein the circumferential-oriented teeth of at least some of the quadrangular cutting elements have coextensive linear longitudinal cutting edges at both ends and a pair of coextensive faces, one on each side of each longitudinal cutting edge at each end of each tooth in angular relation to the other face of each pair and decreasing in width from the base to the outer extremity of each of said cutter elements.

10. The improvement defined in claim 1 wherein the circumferentially-oriented teeth of at least some of the quadrangular cutter elements have coextensive linear longitudinal cutting edges at both ends.

11. The improvement defined in claim 10 wherein each of at least some of the circumferential teeth has a pair of opposed lateral flanks tapering from the base to the outer extremity of its cutter element and terminating at the crest of said tooth in a coextensive linear cutting edge.

12. The improvement defined in claim 1 wherein the radially-oriented teeth as well as said circumferentially-oriented teeth of at least some of the quadrangular cutter elements have coextensive linear longitudinal cutting edges and coextensive faces at both ends.

13. The improvement defined in claim 12 wherein both teeth of at least some of the quadrangular cutting elements have a pair of coextensive faces, one on each side of each longitudinal cutting edge at each end of each tooth in angular relation to the other face of each pair and decreasing in width from the base to the outer extremity of each of said cutter elements.

14. In an earth boring drill bit having a plurality of conical-shaped rotary cutters carrying a plurality of discrete cutter elements, the improvement comprising at least some of the cutter elements of the rotary cutters being quadrilateral in plan, each of said quadrilateral cutter elements including a pair of chisel-shaped teeth coextensive from crest to root and from the outer extremity to the base of said element, the teeth being oriented diagonally of each quadrilateral cutter element whereby the crests of said teeth extend between opposed corners of said element and intersect at their medial portions.

the crest of one of said teeth being directed radially of the axis of rotation of each rotary cutter, the crest of the other tooth being directed circumferentially of the exterior of said rotary cutter whereby said tooth and its crest have leading and trailing ends at opposed corners of said quadrilateral cutter elements, a coextensive cutting edge at the leading end of each circumferential tooth coinciding with the longitudinal edge of the leading corner of said quadrilateral cutter element and extending from the crest to the root of said tooth, the leading corner of said circumferential tooth having a pair of surfaces receding from and coextensive with the longitudinal cutting edge thereof, the pair of surfaces extending outwardly and rearwardly to points medially of said cutter element at its base.

15. The improvement defined in claim 14 wherein at least some of said quadrilateral cutter elements are rectangular in plan.

16. The improvement defined in claim 14 wherein at least some of said quadrilateral cutter elements are diamond-shaped in plan.

17. The improvement defined in claim 14 wherein the pair of surfaces of the leading corner of at least some of said quadrilateral cutter elements are equilateral in plan.

18. The improvement defined in claim 14 wherein at least some of said circumferential teeth have coextensive cutting edges at both their leading and trailing ends and opposed corners of the quadrilateral cutter elements as well as a pair of surfaces receding from each of said cutting edges toward the other opposed corners of said elements.

* * * * *